US010030435B2

(12) United States Patent
Harinck

(10) Patent No.: US 10,030,435 B2
(45) Date of Patent: Jul. 24, 2018

(54) DOOR LEAF WITH PANEL AND PANEL KIT FOR SUCH A DOOR LEAF

(71) Applicant: HARINCK, naamloze vennootschap, Wielsbeke (BE)

(72) Inventor: Kris Andre Harinck, Sint-Baafs-Vijve (BE)

(73) Assignee: HATINCK, NAAMLOZE VENNOOTSCHAP, Wielsbeke (BE)

( * ) Notice: Subject to any disclaimer, the term of this patent is extended or adjusted under 35 U.S.C. 154(b) by 0 days.

(21) Appl. No.: 15/543,160

(22) PCT Filed: Dec. 29, 2015

(86) PCT No.: PCT/BE2015/000071
§ 371 (c)(1),
(2) Date: Jul. 12, 2017

(87) PCT Pub. No.: WO2016/112437
PCT Pub. Date: Jul. 21, 2016

(65) Prior Publication Data

US 2018/0002974 A1 Jan. 4, 2018

(30) Foreign Application Priority Data

Jan. 14, 2015 (BE) ..... 2015/5024
Dec. 18, 2015 (BE) ..... 2015/5834

(51) Int. Cl.
*E06B 3/70* (2006.01)
*E06B 3/72* (2006.01)
(Continued)

(52) U.S. Cl.
CPC ..... *E06B 3/72* (2013.01); *E06B 3/24* (2013.01); *E06B 3/5821* (2013.01); *E06B 3/726* (2013.01);
(Continued)

(58) Field of Classification Search
CPC . E06B 3/72; E06B 3/24; E06B 3/5821; E06B 2003/26389; E06B 3/5892;
(Continued)

(56) References Cited

U.S. PATENT DOCUMENTS 1,496,581 A * 6/1924 Kusterle ..... A47G 1/02 16/DIG. 4
1,964,422 A * 6/1934 Bender ..... E04B 2/78 24/326
(Continued)

FOREIGN PATENT DOCUMENTS

DE 91 08 859 U1 10/1991
DE 9108859 U1 * 10/1991 ..... E06B 3/301
DE 198 24 473 A1 12/1999

OTHER PUBLICATIONS

International Search Report, dated Apr. 29, 2016, from corresponding PCT application.

*Primary Examiner* — Brian E Glessner
*Assistant Examiner* — Adam G Barlow
(74) *Attorney, Agent, or Firm* — Young & Thompson

(57) ABSTRACT

Disclosed is a door leaf including a frame and a door panel with a front leaf, a back leaf and a filler plate. The frame includes conventional profiles with a lip oriented inwards to form a groove. The front leaf is affixed against the front of the frame, and at least partially covers the front of the frame. The door panel is fastened to the back of the frame by panel slats. The front leaf is provided with clamp that enable the front leaf to be pulled against the front of the frame, whereby these clamps are formed by one or more clamps along the periphery of the frame with a basic element that is fastened on the front leaf and a clamping slat affixed thereon that hooks behind an aforementioned lip and can be tightened on the basic element towards the front leaf.

20 Claims, 13 Drawing Sheets

(51) Int. Cl.
*E06B 3/58* (2006.01)
*E06B 3/24* (2006.01)
*E06B 3/263* (2006.01)

(52) U.S. Cl.
CPC ..... *E06B 2003/26389* (2013.01); *E06B 2003/7051* (2013.01)

(58) Field of Classification Search
CPC . E06B 3/728; E06B 3/822; E06B 3/74; E06B 3/827
USPC ..... 52/455, 784.11, 784.12, 784.13, 784.14, 52/784.16, 800.12, 800.13, 800.16, 52/800.18
See application file for complete search history.

(56) References Cited

U.S. PATENT DOCUMENTS 2,579,861 A * 12/1951 Ray ..... E06B 3/88 52/717.06
3,389,505 A * 6/1968 Zitomer ..... E06B 5/003 49/463
6,421,968 B2 * 7/2002 Degelsegger ..... A46D 1/00 52/204.62

* cited by examiner

DOOR LEAF WITH PANEL AND PANEL KIT FOR SUCH A DOOR LEAF

The present invention relates to a door leaf with panel, more specifically on the leaf of a door that is intended to be hingeably mounted in a frame of the door.

A type of door leaf is already known that is produced starting with a frame that is composed of profiles, for example plastic or aluminium, and of a door panel in the form of at least one plate that is affixed therein as a front leaf that is visible on the front of the door, more specifically on the outside of the door. Generally a door panel is used in the form of a sandwich panel or double glazing or similar, whereby this door panel is composed of two or more plates, with at least a front leaf on the front of the door and a back leaf on the back of the door.

Conventionally the door manufacturer starts with a frame made of his own profiles and the panel is purchased from a supplier of such panels.

Conventionally the door manufacturer uses conventional profiles with a front wall and a back wall, respectively on the front and back of the frame, an inner wall and an outer wall, respectively on the inner edge and outer edge of the frame, whereby the inner wall of the profiles is provided with a lip oriented inwards with a seal to form a groove in which the panel is affixed resting against the seal on the back of the lip and whereby the panel is held by means of a panel slat with a seal that is fastened on the aforementioned inner wall of the profiles, such that the panel is held all around along its edges between the seals of the aforementioned lip of the profiles and the panel slat, whereby the panel slats with seal are intended to cover and seal the gap between the panel and groove against water and dust.

A disadvantage of such doors is that the aforementioned lip of the profiles rests on the front leaf and thereby forms a raised edge, which for some people interferes with the nice appearance of the door.

For this reason panels are also used whose front leaf is glued to the front of the frame, whereby the front leaf essentially has the same dimensions as the outer periphery of the front of the frame, so that the front of the frame is completely covered by the front leaf of the panel and a modern, taut, even front leaf is thus obtained on the front of the door.

In such a case the groove of the profiles is not used for the mounting of the panel and this lip is generally completely sawn away all around to have more space for the filler plate. This is certainly the case for the renovation of a door leaf where such a lip is always present.

A disadvantage is that the sawing away of the lip requires extra working time that has a negative influence on the cost of the door.

Another disadvantage is that the gluing of the front panel on the frame must be done very carefully and that this must be done in controlled conditions in a workshop or similar using clamps or similar to press and hold the front leaf with its edges aligned against the frame during the drying of the adhesive.

The affixing of the clamps also requires extra working time and must be done precisely by personnel with sufficient experience.

The purpose of the present invention is to provide a solution to one or more of the aforementioned and other disadvantages.

To this end the invention concerns a door leaf comprising a frame and a door panel with a front leaf and a back leaf, whereby the frame is composed of conventional profiles with a front wall and back wall, respectively on the front and back of the frame, an inner wall and an outer wall, respectively on the inner edge and outer edge of the frame, and a lip oriented inwards is provided on the inner wall of the profiles to form a groove and whereby the front leaf is affixed against the front of the frame, hereby at least partially covering the front of the frame, with the characteristic that the front leaf is provided with clamping means that enable the front leaf to be pulled against the front of the frame, whereby these means are formed by one or more clamps along the periphery of the frame with a basic element that is fastened on the front leaf and a clamping arm affixed thereon that hooks behind an aforementioned lip and can be tightened on the basic element towards the front leaf.

In this way the lip is usefully used to fix the door panel, at least in the first instance the front leaf, on the frame by clamping without it being necessary for the front leaf to be glued to the front of the frame.

The clamping then does not require a conditioned working space as is the case with gluing.

The clamping also requires less in-depth experience than in the case of gluing and also takes less time, primarily because no drying time is required for letting the adhesive dry.

Moreover, a correction of the alignment of the front leaf with respect to the periphery of the front is always possible, to which end it is sufficient to loosen the clamping means and tighten them again after repositioning the front leaf.

In brief, the door manufacturer can save a lot of time in this way and he can also make use of his standard profiles with groove and lip.

Due to the fact that use can be made of a frame with standard profiles, the front leaf can also be mounted on an existing frame, for example for the purpose of renovating the door leaf.

The basic elements of the clamping means can be glued on the back of the front leaf, for example by means of double-sided tape.

Alternatively the front leaf can also be made of metal, for example aluminium, and the basic elements of the clamping means are fastened on the front leaf by means of fishplate bolts that are welded on the back of the front leaf and which extend transversely to the plane of this back, although other fastening techniques and materials are not excluded, for example by bonding bolts on a glass fibre plate.

As a result the basic elements can be fastened firmly on the front leaf through a suitable choice of fastening techniques, such that the clamping means can be tightened with relatively large forces for a sturdy fastening of the front leaf in the frame.

Preferably the clamping means are provided with screwing means to tighten the clamping slat against the lip of the profiles, such that the clamping slats can be screwed tight steplessly with standard means.

According to a particular aspect a filler plate or spacer is provided between the front leaf and the back leaf and clipping means are provided with which the back leaf is fastened or can be fastened against the back of the filler plate in a detachable way, although the invention is not strictly limited to this and the back leaf can only be fastened by means of the aforementioned panel slats for example.

In this way the back leaf can be detached at any time for a change of the jamb or replacement or similar, without the frame or the front leaf having to be replaced or adapted.

According to a practical embodiment the clipping means are formed by a series of clips that are fastened on the front of the back leaf and which are provided with arms that spring out sideways with which the clips are clamped in corresponding openings in the filler plate.

Preferably, in that case a reinforcing plate made of an incompressible material such as aluminium is affixed on the back of the filler plate, whereby this cover plate is provided with passages corresponding to the openings in the filler plate and with a diameter that is somewhat smaller than the largest external diameter of the clips in their rest position.

This reinforcing plate ensures that the edges of the openings in the filler plate are strengthened and that the arms of the clips that spring outwards can snap in under the edges of the passages in the reinforcing plate, which is especially useful when the filler plate is made of a relatively soft and compressible material.

The clips can be tapered, narrowing in a direction away from the back plate, which ensures automatic centring when introducing the clips in the openings and passages.

Preferably the clips are screw clips that are fastened on the back leaf by means of fishplate bolts that are fastened on the front of the back leaf.

This ensures a strong fastening of the clips.

According to another aspect of the invention the front leaf and/or the back leaf can be made of a transparent or translucent material such as single glass, double glass or laminated glass, Plexiglas, ceramic, plastic or similar, whereby the clamping means are glued with a suitable adhesive or double-sided tape to the back of the front leaf.

The invention also relates to a panel kit for assembling a door leaf according to any one of the previous claims, starting with a frame made of standard profiles with a lip to form a groove, whereby this panel kit is composed of one or more of the following elements or a combination thereof:

- a front leaf with one or more basic elements affixed thereon at a distance from the peripheral edge forming part of clamping means to clamp the front leaf to the frame;
- one or more clamping slats that can engage with the basic elements of the clamping means;
- means to be able to tighten the clamping slats on the basic elements;
- a separate back leaf.

Furthermore, preferably in this panel kit:

- the front leaf is provided with a filler plate or a spacer that extends between the basic elements, and which is fastened against the back of the front leaf and which is provided with a series of openings;
- the filler plate or spacer may be provided with a reinforcing plate that is fastened against the back of the filler plate, and which is provided with passages corresponding to the openings in the filler plate;
- the back leaf is provided with clipping means that can engage with the openings and passages in the filler plate and any reinforcing plate in order to be able to fasten the back leaf against the filler plate or reinforcing plate.

The thickness of the door panel can be chosen such that the door panel can be clamped or held by means of the aforementioned panel slats or that the back of the back leaf is aligned with the back of the frame, whereby a clearance is left between the back leaf and the frame that can be covered with decorative slats, which can be chosen to be minimal so that a covering is not required.

Alternatively the back leaf can also be affixed in the frame such that it is apparently floating, i.e. with a small uncovered gap between the back leaf and the frame, or affixed overlapping the back of the frame, in which case the back leaf with the overlapping part can be fastened against the frame by gluing or similar.

With the intention of better showing the characteristics of the invention, a preferred embodiment of a door leaf according to the invention and a panel kit for such a door leaf is described hereinafter by way of an example, without any limiting nature, with reference to the accompanying drawings, wherein:

FIG. 1 schematically shows an outside door along the front, whereby the left half presents a conventional door and the right half presents a door with a door leaf according to the invention;

FIGS. 10 to 14 show different variants of a door leaf with a glass panel.

Figure 1:
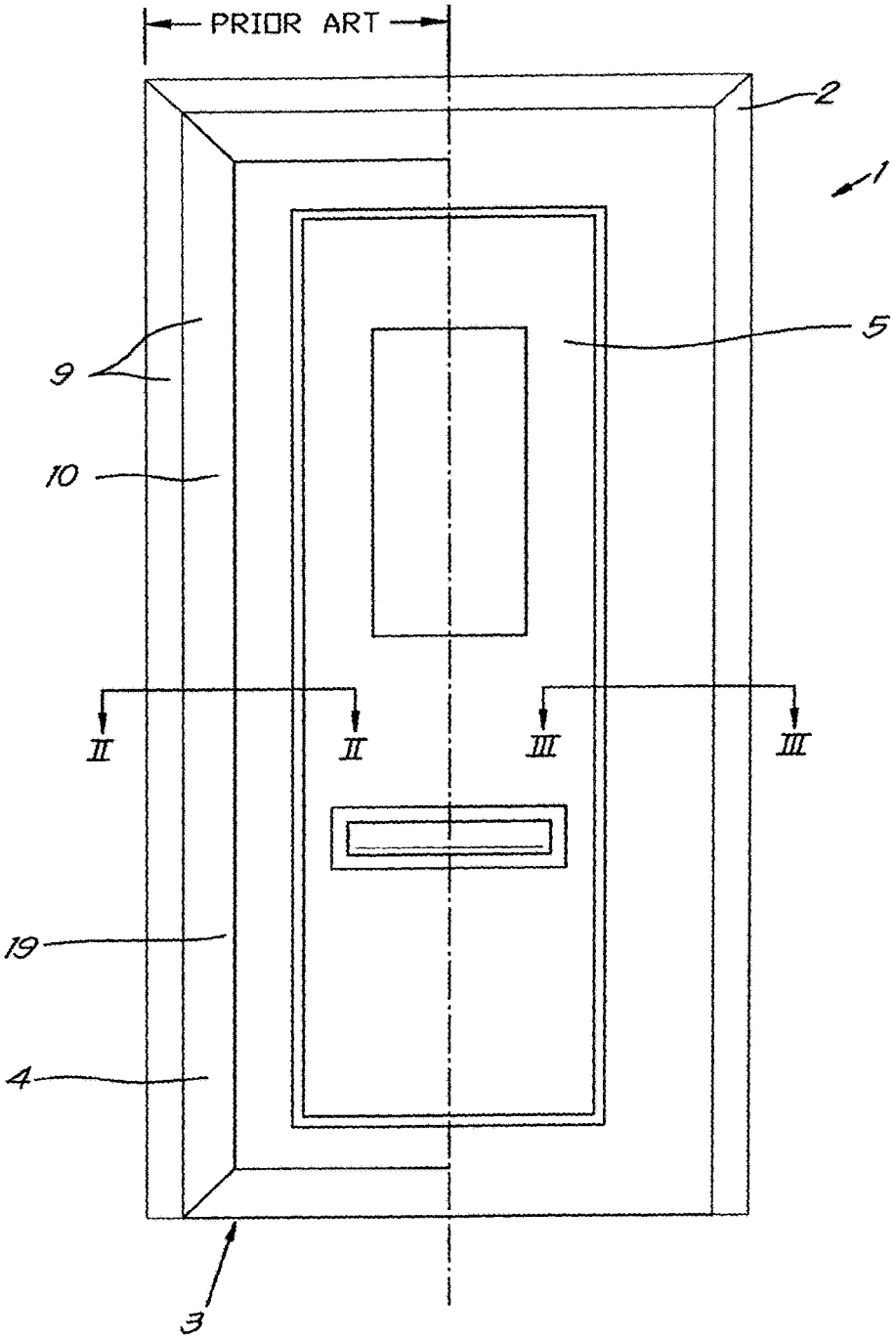

The outside door 1 shown in FIG. 1 comprises a fixed door frame 2 that is intended to be fastened in a wall hole and a hingeably affixed door leaf 3 therein.

The door leaf 3 is composed of a frame 4 and a door panel 5 affixed thereon that is constructed as a sandwich panel with a front leaf 6 on the front of the door, more specifically on the outside of the door and a back leaf 7 on the back, more specifically the inside of the door, and in between a filler plate 8 of an insulating or other material.

The front leaf 6 and the back leaf 7 are preferably made of a weldable material such as aluminium.

Figure 2:
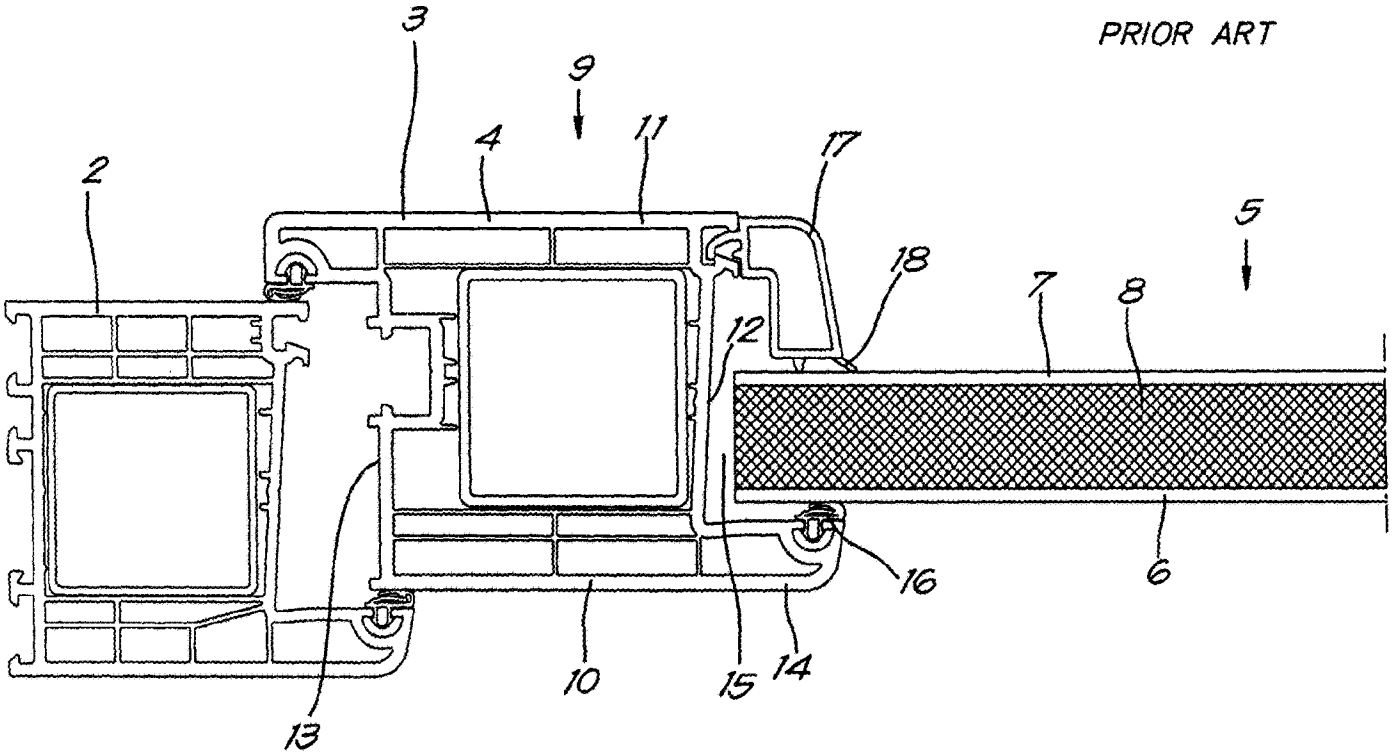
FIG. 2 shows a cross-section of a conventional door according to line II-II of FIG. 1.
Figure 3:
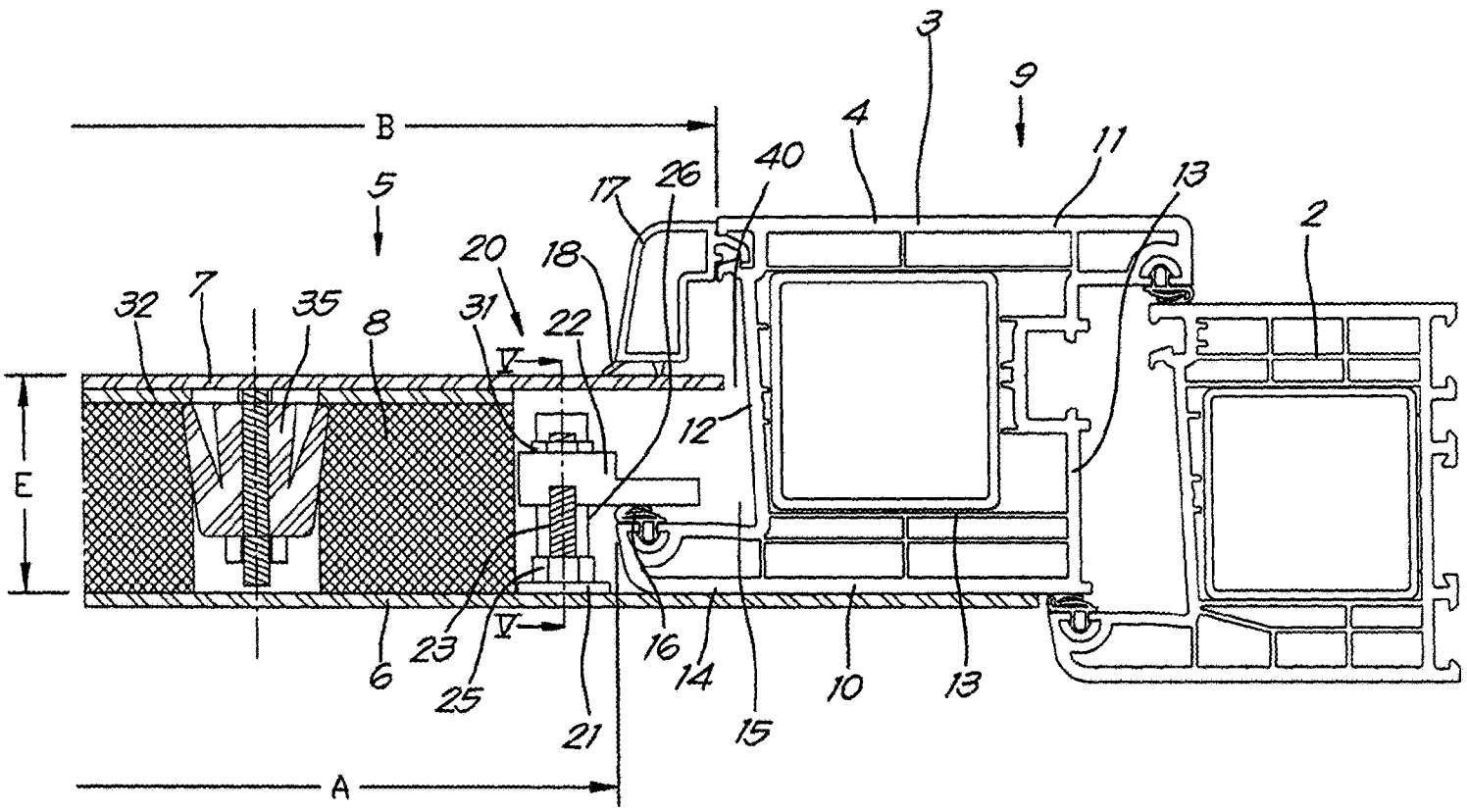
FIG. 3 shows a cross-section of a door according to the invention along line III-III of FIG. 1.
Figure 4:
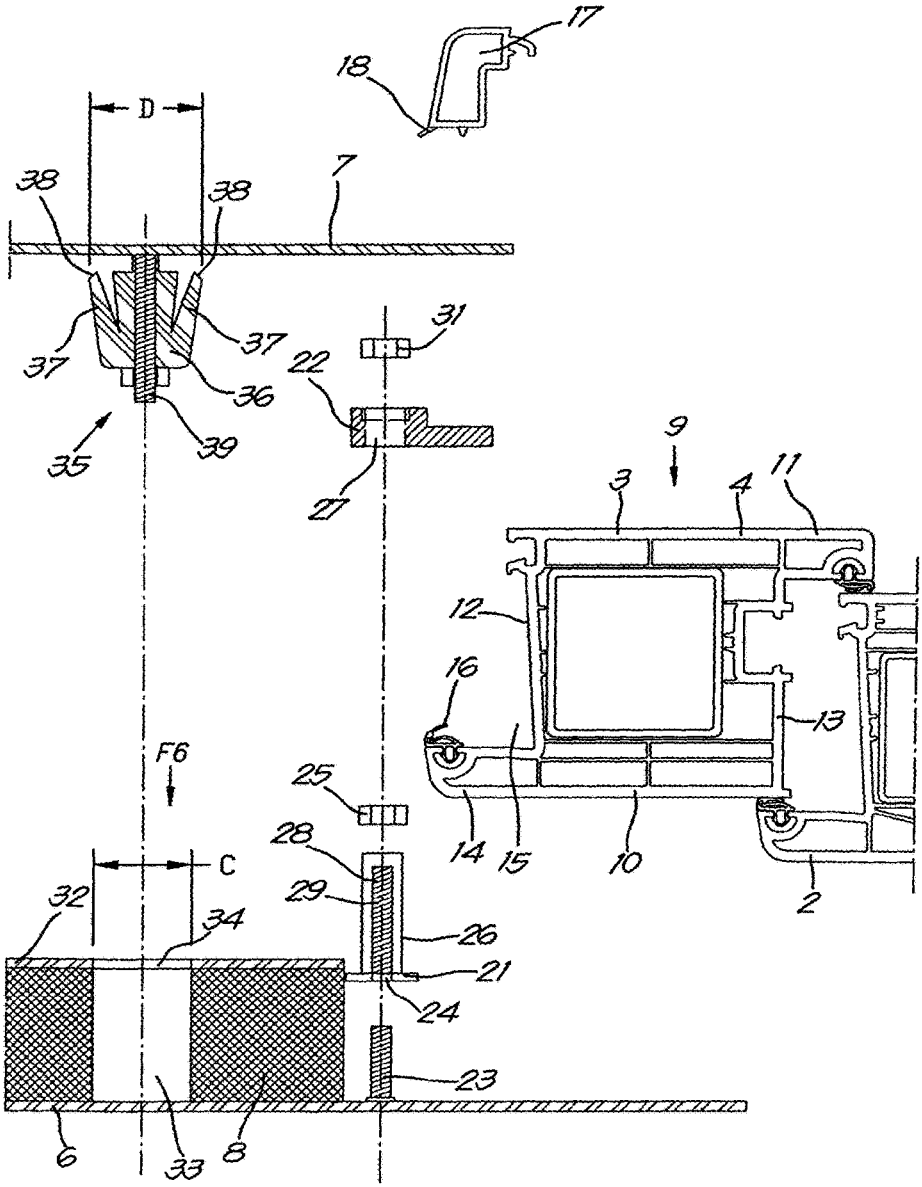
FIG. 4 shows the cross-section shown in FIG. 3, but with the door leaf in an unmounted state.
Figure 5:
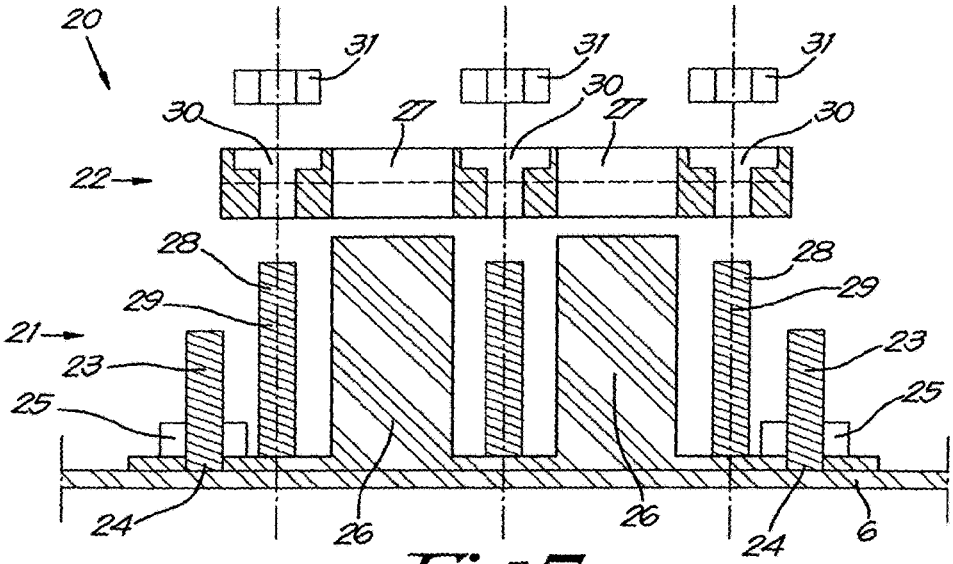
FIG. 5 shows a cross-section according to line V-V of FIG. 3.
Figure 6:
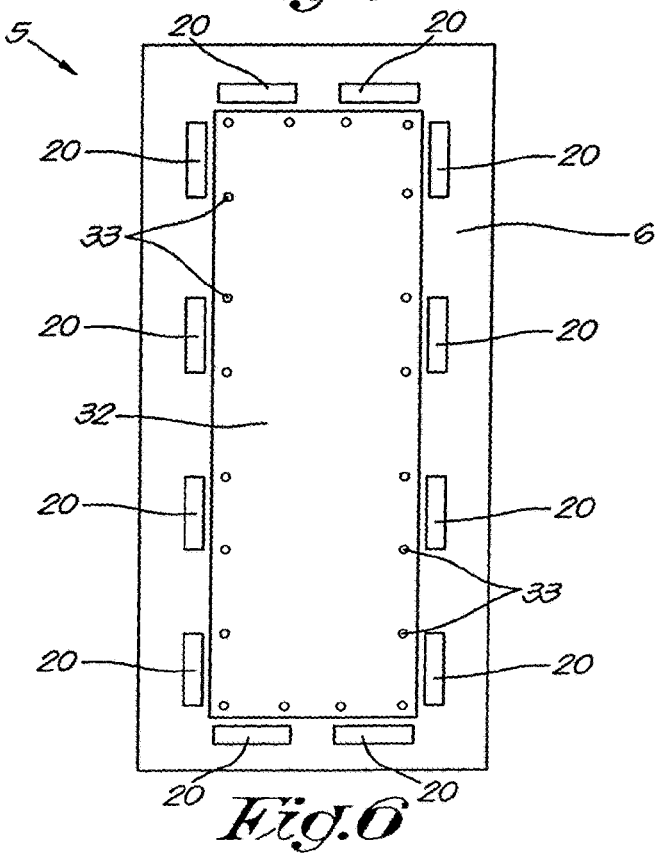
FIG. 6 shows a rear view according to arrow F6 of FIG. 4.

The frame 4 of the door leaf 3 is a conventional frame 4 that is identical for the conventional door leaf in the left part of FIG. 1 and in the corresponding cross-section of FIG. 2 and for a door leaf 3 according to the invention as shown in the right part of FIG. 1 and in the corresponding cross-section of FIG. 3.

This frame 4 of the door leaf 3 is composed of standard profiles 9 of aluminium, plastic, wood or similar with a front wall 10 and back wall 11, respectively on the front and the back of the frame 4, an inner wall 12 and an outer wall 13, respectively on the inner edge and the outer edge of the frame 4, and on the inner wall 12 of the profiles 9 a lip 14 oriented inwards to form a groove 15, whereby in the example shown this lip 14 is provided with a seal 16 over its entire length.

The groove 15 is provided for a conventional door leaf to mount the door panel 5 in a known way that is pressed along its periphery onto the front of the frame 4 against the seal 16 of the lip 14 by means of a panel slat 17 that is fastened on the frame 4 all around the back, and which is provided with a second seal 18 that presses on the back of the door panel as is clearly shown in FIG. 2, whereby the door panel 5 is held along its edges between the seals 16 and 18, respectively of the lip 14 and the panel slat 17.

As shown by the left part of FIG. 1, on the front of the door 1, more specifically on the outside of the door 1, an upright edge 19 can be seen around the visible part of the door panel 5 that is formed by the visible part of the frame 4 of the door leaf, whereby this upright edge 19 is regarded by some as annoying.

In the door leaf 3 according to the invention such as in the right part of FIG. 1, this annoying upright edge 19 is concealed by the front of the frame 4, in this case it is completely covered by the front leaf 6 that is mounted against it and which thus essentially has the same outer dimensions as the frame 4.

For the fastening of the front leaf 6 to the conventional frame 4, according to the invention the front leaf 6 is provided with clamping means 20 that enable the front leaf 6 to be pulled against the front of the frame 4.

In the example, these clamping means 20 are formed by one or more clamps along the periphery of the frame 4 with a basic element 21 that is fastened to the back of the front leaf 6 and a clamping slat 22 affixed thereon that hooks behind an aforementioned lip 14 with its seal 16 and can be tightened on the basic element 21 towards the front leaf 6.

In the example shown, the basic elements 21 are fastened on the front leaf 6 by means of fishplate bolts 23 that are welded on the back of the front leaf 6 and which extend transversely to the plane of this back through passages 24 in the basic element 21 and nuts 25 that are screwed on the fishplate bolts 23.

The basic elements 21 are provided with guides 26 for the clamping slats 22 that extend transversely to the plane of the front leaf 6.

The clamping slats 22 are provided with passages 27 to this end whereby the clamping slats 22 slide over the guides 26 with a close fit.

Furthermore the clamping means 20 are provided with screwing means in order to tighten the clamping slat 22 along the guides 26 against the seal 16 of the lip 14 of the profiles 9, whereby these screwing means are shown in the drawings as a peg 28 with a screw thread 29 that forms part of the basic element 21 and which extends through a passage 30 in the clamping slat 22 and by nuts 31 that are screwed onto the pegs 28.

The filler plate 8 has dimensions that are somewhat smaller than the door openings A of the frame 4 and it is glued by one side to the back of the front leaf 6.

If the filler plate 8 is made of a relatively soft and compressible material, a reinforcing plate 32 made of a non-compressible material such as aluminium, and which may or may not be perforated, is affixed on the back of the filler plate 8. The reinforcing plate 32 is glued to the filler plate for example.

Openings 33 are provided in the filler plate 8 according to a certain pattern, whereby these openings are distributed at least along the edges of the filler plate 8 while corresponding passages 34 are provided in the reinforcing plate 32 that are centred with respect to the openings 33 in the filler plate 8.

The back leaf 7 is provided with clipping means 35 with which it is detachably fastened against the back of the filler plate 8 or reinforcing plate 32.

The clipping means 35 are preferably formed by a series of clips 36 that are fastened on the front of the back leaf 7 and which are provided with arms 37 that spring out sideways 37 with which the clips 36 are clamped in the corresponding openings 33 in the filler plate and/or can be hooked behind the edges of the passages 34 in the reinforcing plate 32 as shown in FIG. 3, in which case the diameter C of these passages 34 is chosen to be somewhat smaller than the largest external diameter D of the clips 36 in their rest position.

The clips 36 are tapered, narrowing in a direction away from the back plate 7. The ends of the arms 37 are provided with a bevel 38.

In the example shown the clips 36 are screw clips that are fastened on the back leaf by means of fishplate bolts 39 that are welded on the front of the back leaf 7, although other fasteners are not inconceivable.

The dimensions of the back leaf 7 are somewhat smaller than the groove dimensions B of the frame 4 and larger than the dimensions of the filler plate 8, so that the back leaf 7 almost covers the entire groove 15 and the clamping means 20.

The gap 40 between the peripheral edge of the back leaf 7 and the frame 4 is covered by affixing the panel slats 17 that conventionally belong to the profiles 9 of the frame 4 and which press with their seal on the back of the periphery of the back leaf 7.

To this end a suitable composite thickness E is chosen for the filler plate 8, provided or otherwise with a reinforcing plate 32 and the back plate 7.

Instead of a solid filler plate it is not excluded using a hollow plate or spacer, for example in the form of a collar that is affixed all around within the periphery of the clamping slats 22 against the back of the front leaf 6 and which is provided with openings 33 for fastening the back leaf 7 using the clipping means 35 or with other means.

Starting with an existing conventional frame 4, old or new, the door manufacturer can easily assemble a taut, modern, nice looking door leaf from a panel kit that he can order tailor-made from the panel supplier.

For example such a panel kit comprises a basic kit that is composed as follows:

- a front leaf 6 with one or more basic elements 21 affixed thereon;
- a corresponding number of clamping slats 22 that can be affixed on the basic elements 21 and can be tightened thereon;
- means 31 for being able to tighten the clamping slats 22 on the basic elements 21;
- a separate back leaf 7.

In addition, for fastening the back plate 7 in the frame 4 the basic kit can be supplemented as follows with:

- a filler plate 8 or spacer that is fastened against the back of the front leaf 6 and which is provided with a series of openings 33;
- if need be a reinforcing plate 32 that is fastened against the back of the filler plate 8 and which is provided with passages 34 corresponding to the openings 33 in the filler plate 8;
- a separate back leaf 7 with clipping means 35 thereon that can engage with the openings 33 and passages 34 in the filler plate 8 and possibly a reinforcing plate 32 in order to be able to fasten the back leaf 7 against the filler plate 8 or reinforcing plate 32.

The assembly of the panel kit by the door manufacturer in a conventional frame is very simple and as follows.

First the front leaf 6 is affixed against the front of the frame 4 with the filler plate 8 affixed thereon, any reinforcing plate 32 and basic elements 21 oriented towards the back of the frame 4 and this front leaf 6 is clamped by means of the clamping slats 22 supplied that are screwed tight against the seal 16 of the lip 14 of the profiles 9.

Afterwards the back leaf 7 is affixed by pushing the clips 36 through the passages 34 in the reinforcing plate 32 in the openings 33 in the filler plate 8, whereby due to the smaller diameter C of the passages 34 in the reinforcing plate 32 and the tapered form of the clips 36, the arms 37 of the clips 36 are automatically squeezed, after which, after their passage through the passages 34 in the reinforcing plate 32, they automatically spring back sideways and hook on behind the edges of the passages 34 in the reinforcing plate 32 and/or clamp in the openings 33 in the filler plate 8.

The clipping fast of the back leaf 7 ensures correct centring of the back leaf 7 with respect to the front leaf 6 and with respect to the groove 15.

Then it is sufficient for the door manufacturer to affix his panel slats 17 with seal 18 to finish the door leaf.

It is clear that the door leaf 5 can easily be dismantled in the reverse order, for example for a repair or replacement of the door panel 5 by another.

It is also clear that such a panel kit can also be used for the renovation of an existing door 1, whereby the old door panel 5 is removed from the frame and replaced by a covering door panel 5 as described above.

It is also clear that the clipping means 35 can also be realised in different ways, for example by means of compressible elements, and that the clipping means can even be omitted, for example when exact centring of the back leaf 7 in the groove 15 is not required.

Figure 7:
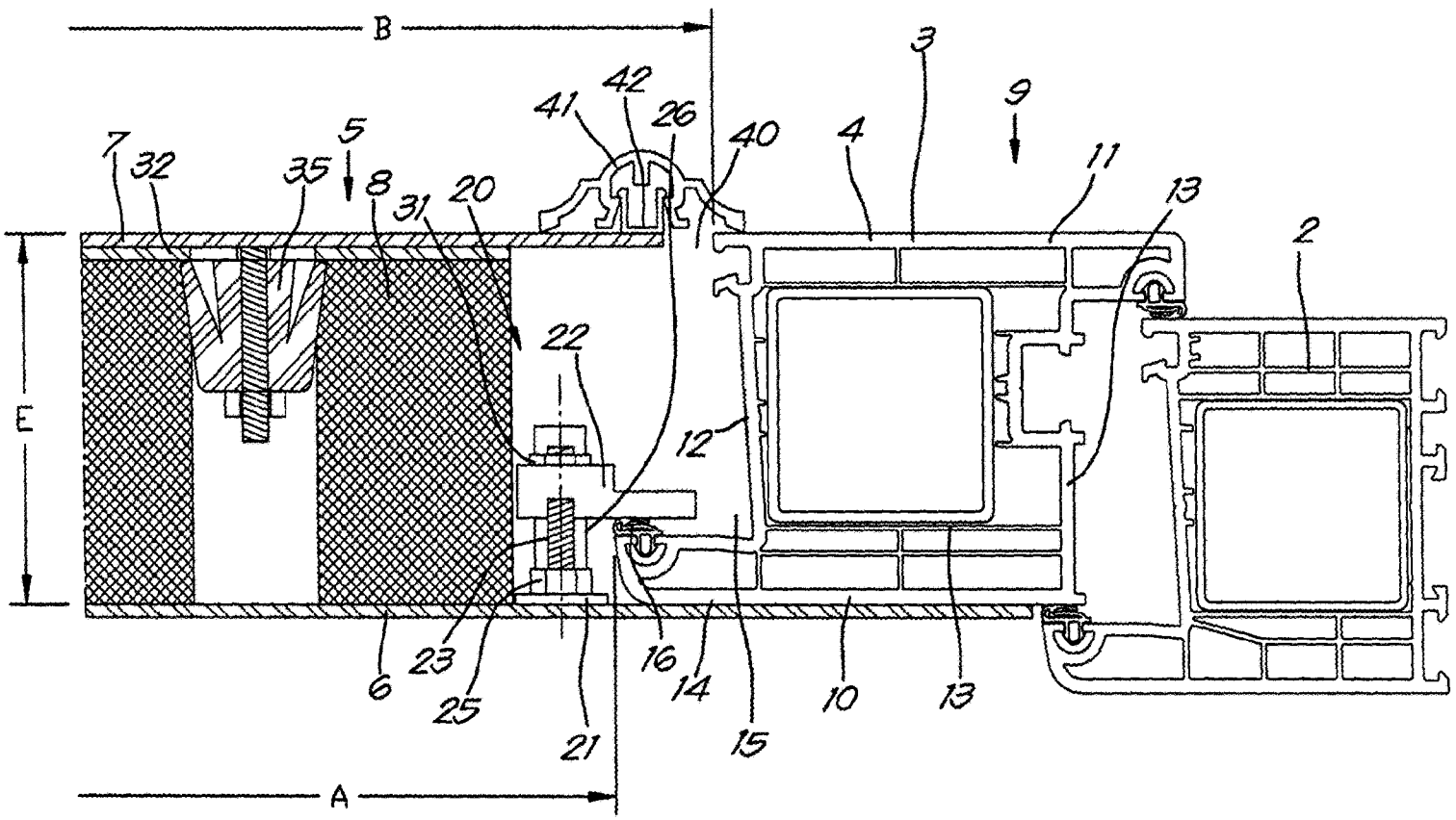
FIG. 7 shows a variant of a door leaf according to the invention.

FIG. 7 shows an outside door with a variant of a door leaf 3 according to the invention.

In this case the thickness E is constructed such that the back of the back leaf 7 is approximately in line with the back of the frame 4.

The gap 40 between the peripheral edge of the back leaf 7 and the frame 4 is in this case covered by a decorative slat 41 that is fastened on the back of the back leaf 7 or alternatively on the back of the frame 4 by means of an auxiliary profile that is fastened on the back leaf 7 or on the frame, for example by means of screws, adhesive or similar, and which enables the decorative slat 41 to be clipped or clamped on the auxiliary profile 42.

The covering by means of a decorative slat 41 and auxiliary profile 42 can of course also be applied in a situation such as that of FIG. 3 in replacement of the clamping slat 17.

Figure 8:
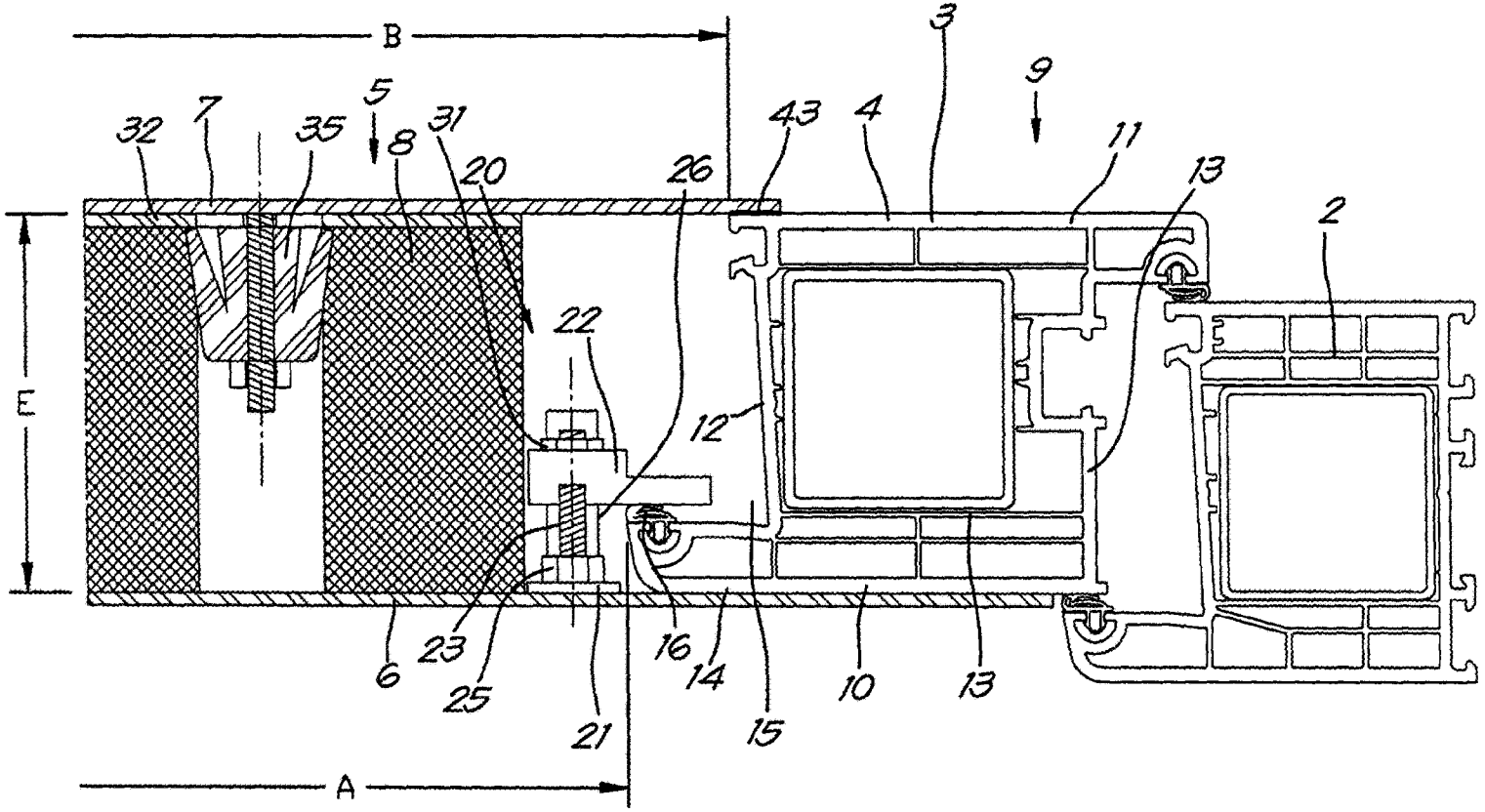
FIGS. 8 and 9 show another variant of a door leaf according to the invention.

FIG. 8 shows a door with a variant of a door leaf 3 according to the invention.

This embodiment differs in that the dimensions of the periphery the back leaf 7 are larger than the groove dimensions B of the frame 4 and that the back of the frame is covered, at least partially overlapping, by this oversized back leaf 7.

In this case, the thickness E is preferably chosen such that the back leaf 7 rests against the back of the frame 4.

The back leaf 7 is held fast by the clips 36 and/or by gluing or similar of the back leaf 7 against the back of the frame 4, for example by making use of double-sided tape as illustrated in FIG. 8.

Preferably the back leaf 7 rests against the filler plate 8, although there can also be a gap between the two.

It goes without saying that the filler plate 8 does not necessarily have to be a solid plate, but that it can also be a hollow filler plate or a filler plate in the form of a sandwich panel or similar.

Figure 9:
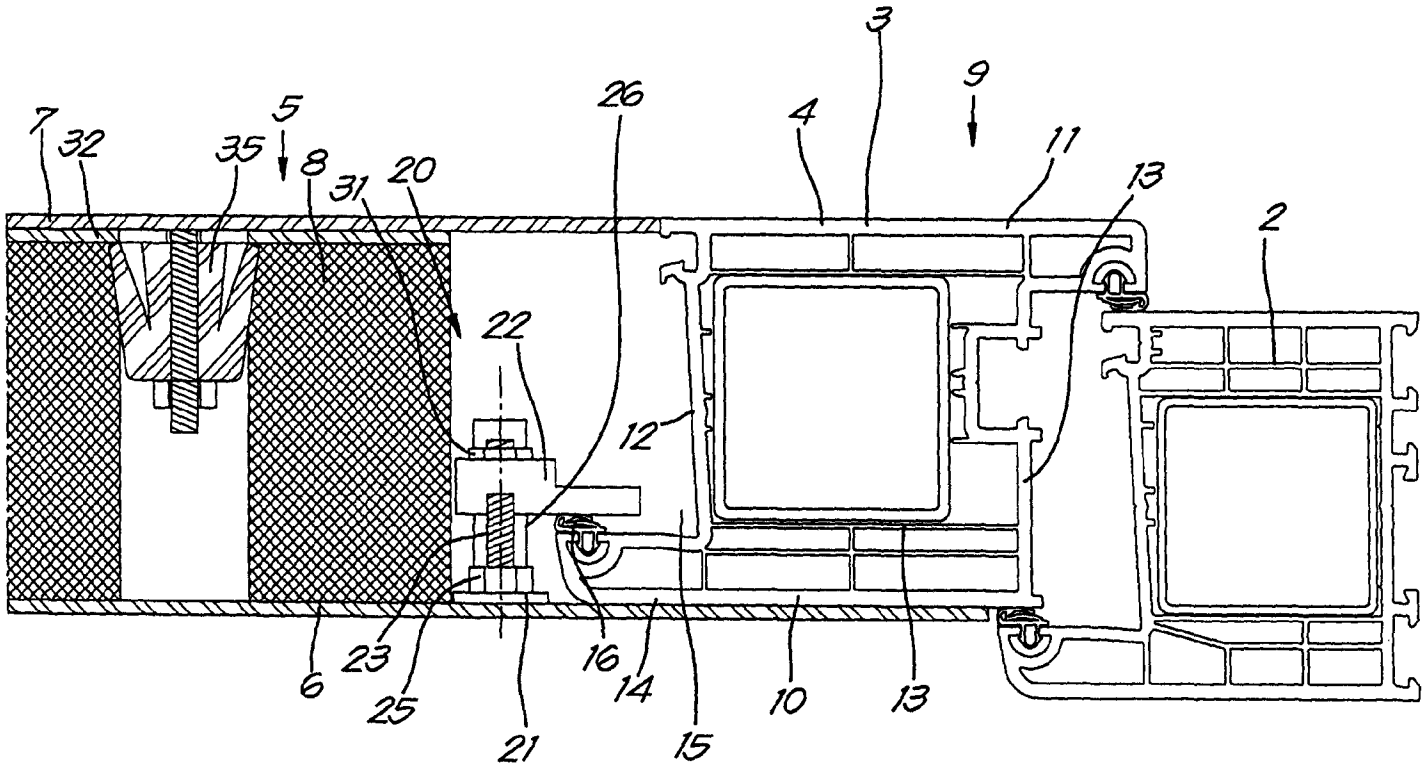

FIG. 9 shows a variant embodiment of the embodiment of FIG. 7 that differs from it by the back leaf 7 now extending to against or practically against the inner wall of the frame 4, so that in this case the gap 40 has a minimal width. In this case, this gap 40 is not very annoying so that a decorative slat 41 is superfluous, but not necessarily excluded.

FIGS. 10 to 13 show possible variants whereby the door leaf is made of a transparent or translucent material such as glass, Plexiglas or another plastic, ceramic or similar.

Figure 10:
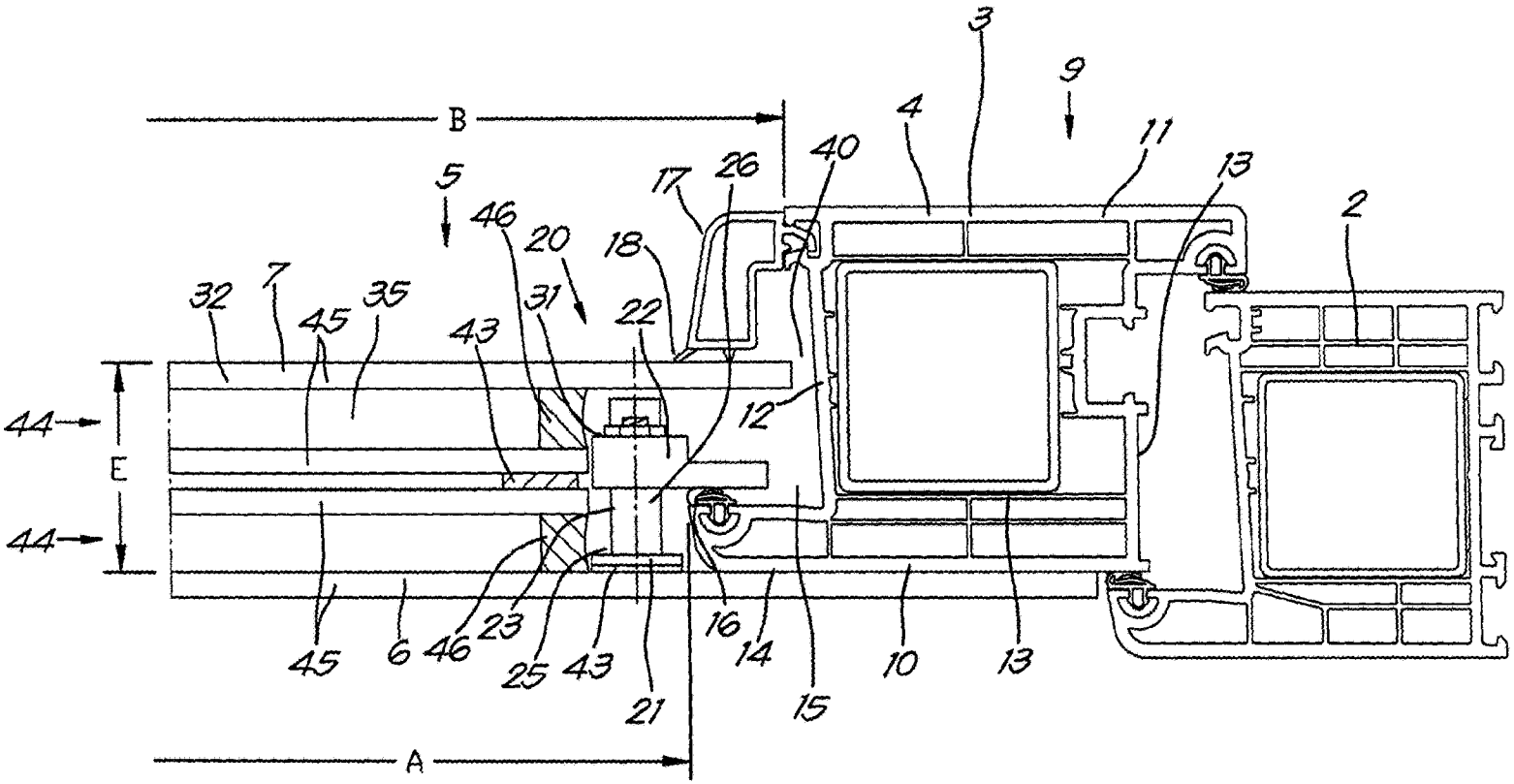

In the case of FIG. 10, for example, double glass 44 is used consisting of two sheets of glass 45 with a seal 46 all around in order to close off the space in an airtight way between the sheets of glass 45 for heat insulation.

In this case the front leaf 6 is formed by the front sheet of glass 45 of the front double glass 44, whose front sheet of glass 45 is oversized so that it can at least partially overlap the lip 14 of the frame 4, while the back sheet of glass 45 is smaller to make room for the clamping means 20 that are provided with basic elements 21 that are fastened along the periphery of the back sheet of glass 45 on the back of the front sheet of glass 45, in this case glued with double-sided tape 43 or similar, instead of using fishplate bolts 23 that can be omitted in this case.

In this case, the back leaf 7 is formed by the back sheet of glass 45 of a second double glass 44, whose front sheet of glass 45 has practically the same dimensions as the back sheet of glass 45 of the front double glass 44 and the back sheet of glass is larger so that it can be mounted overlapping the clamping means 20 in the frame 4 by fastening the second double glass 44 with the front against the back of the first double glass 44, for example by means of double-sided tape 43 between the two glass sets 44.

In the case of FIG. 10 the gap 40 between the back sheet of glass 45 of the back double glass 44 is covered by means of a panel slat 17.

Figure 11:
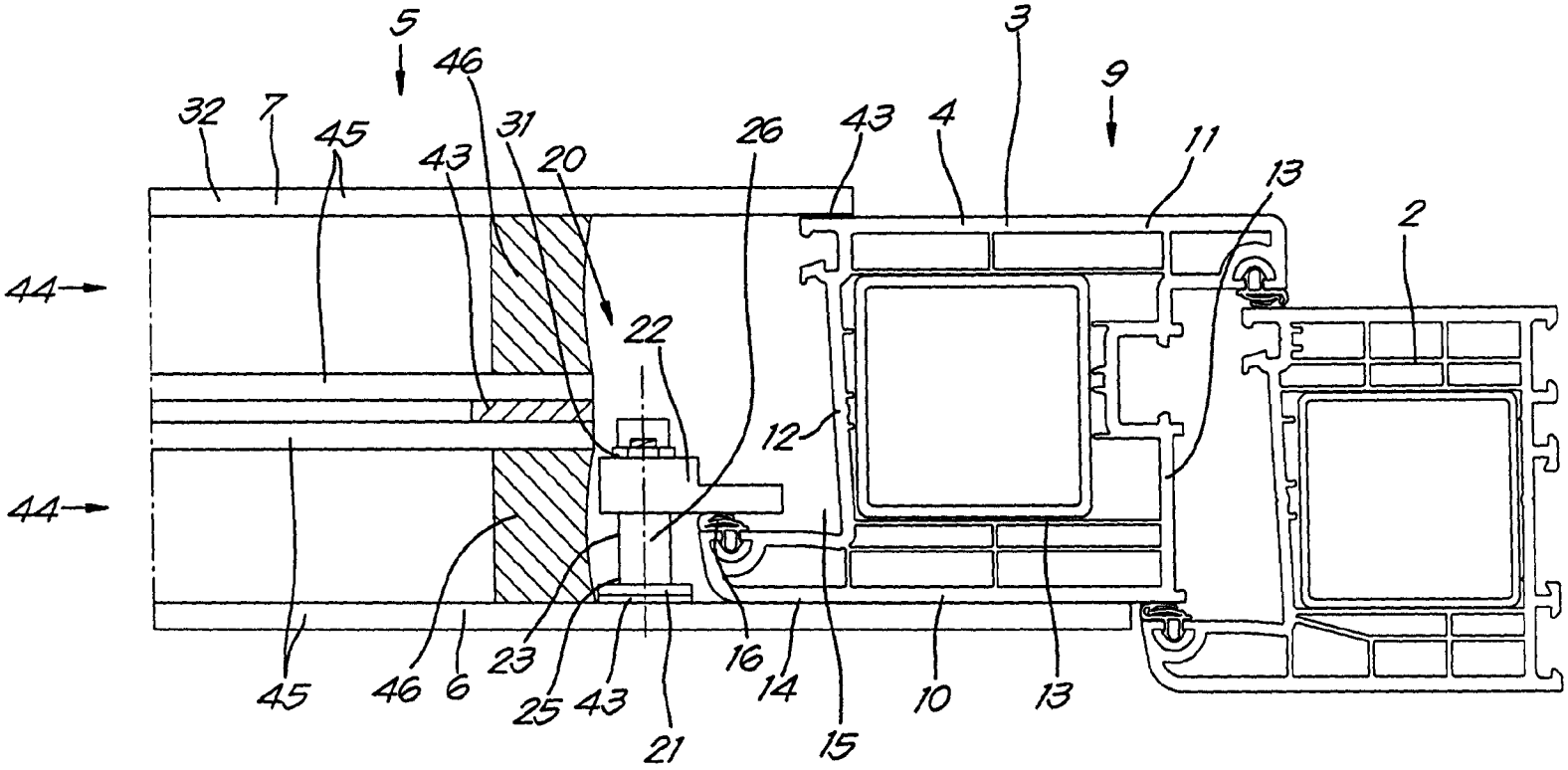
Figure 10:
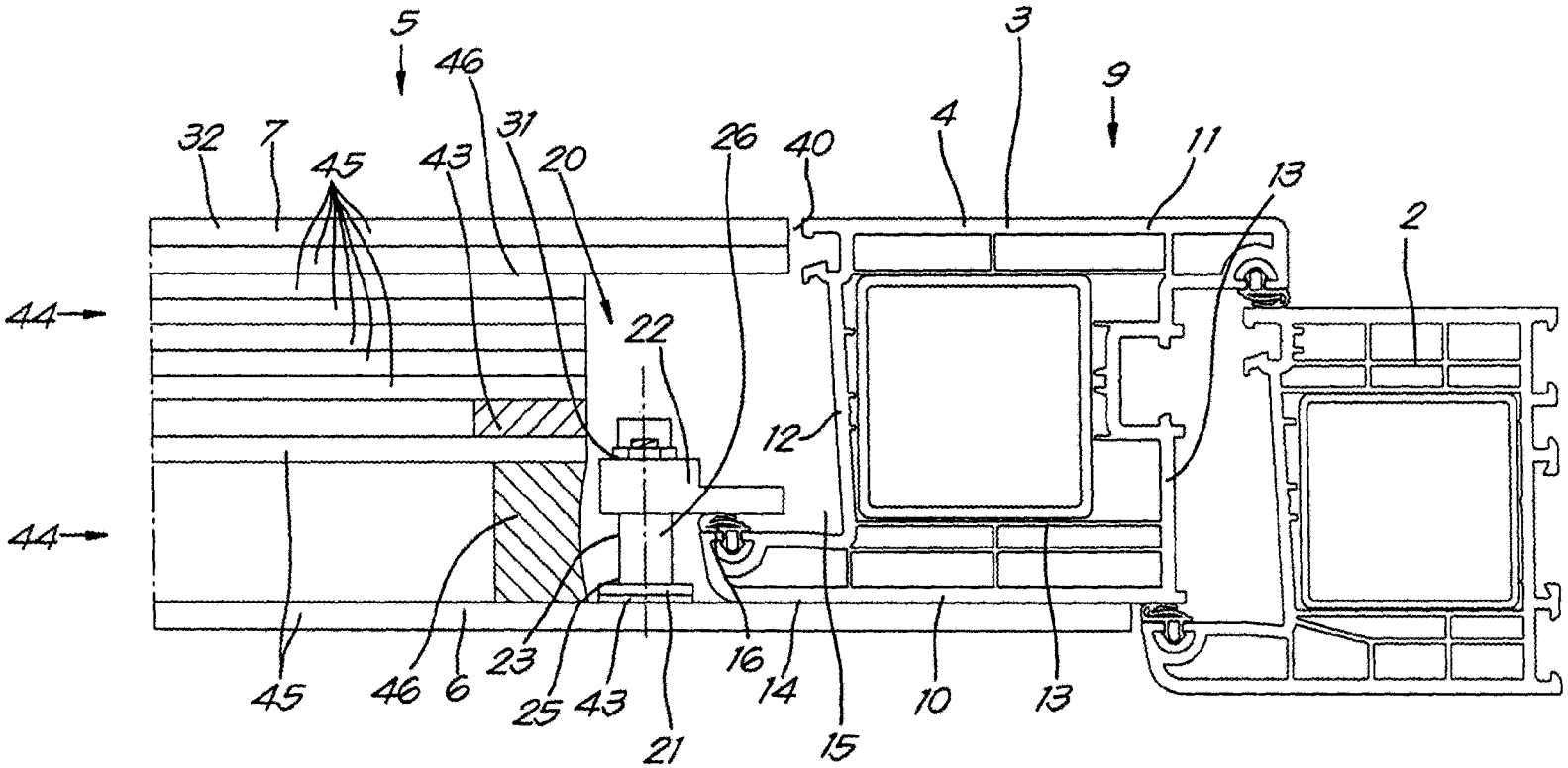

The embodiment of FIG. 11 differs from that of FIG. 10 in the fact that in this case the back sheet of glass 45 of the back double glass 44 partially overlaps the back wall 11 of the profiles 9 of the frame 4, whereby this overlapping part can be fastened against this back wall 11 by double-sided tape 43 or similar.

FIG. 12 shows a variant whereby in this case double glass and laminated glass 44 are combined, whereby the back leaf 7 is composed of two sheets of glass 45 of the laminated glass 44 and the back leaf 7 draws level with the back wall 11 of the frame 4 with a minimal gap 40 between the two, which in the case of FIG. 12 is not covered, but which alternatively can also be covered by a decorative slat or similar.

Figure 13:
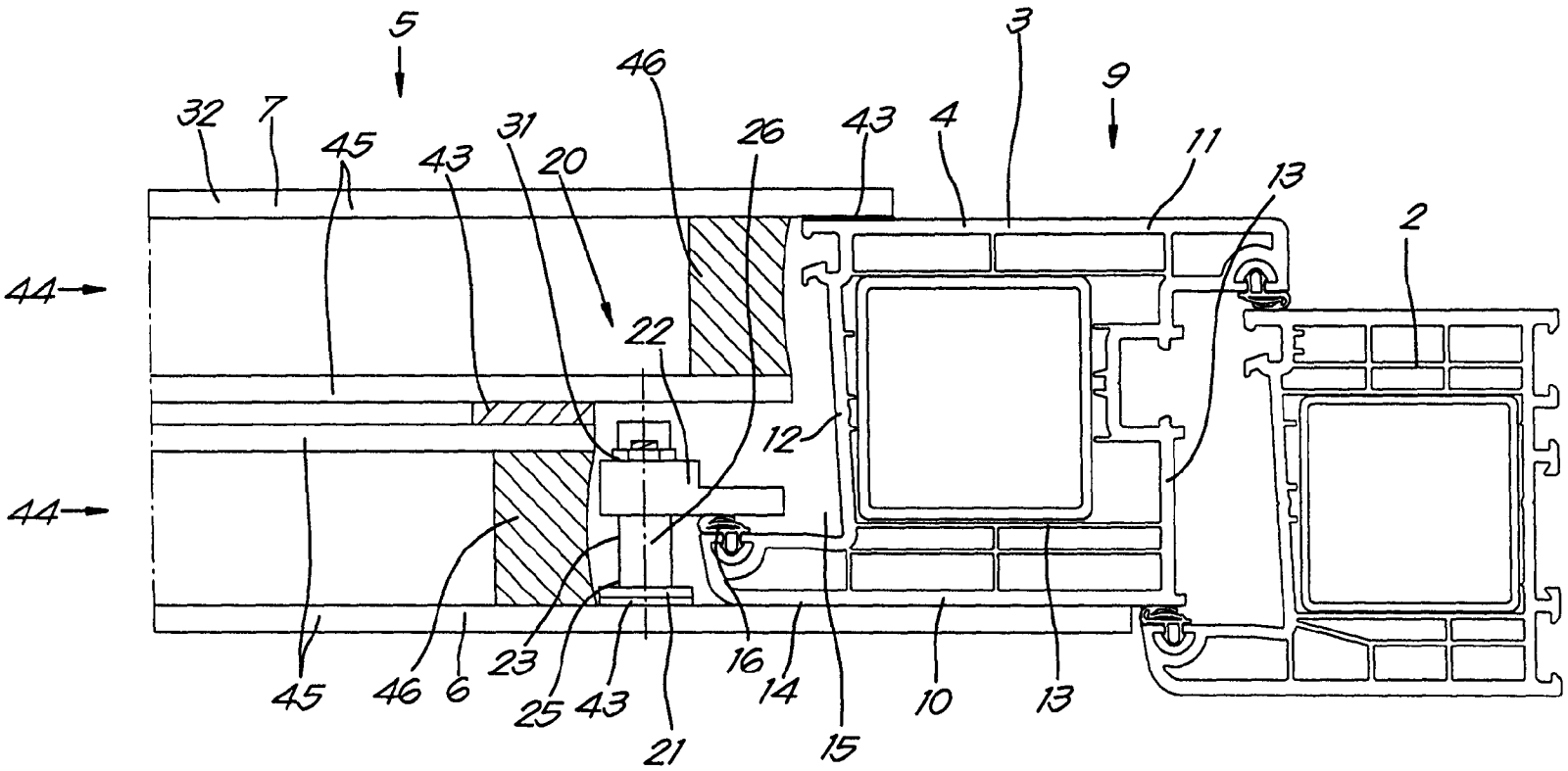

The embodiment of FIG. 13 corresponds to that of FIG. 11 with the difference that the back double glass 44 now also covers the clamping means 20 with the front sheet of glass 45 that is made larger than the back sheet of glass 45 of the front double glass 44.

Figure 14:
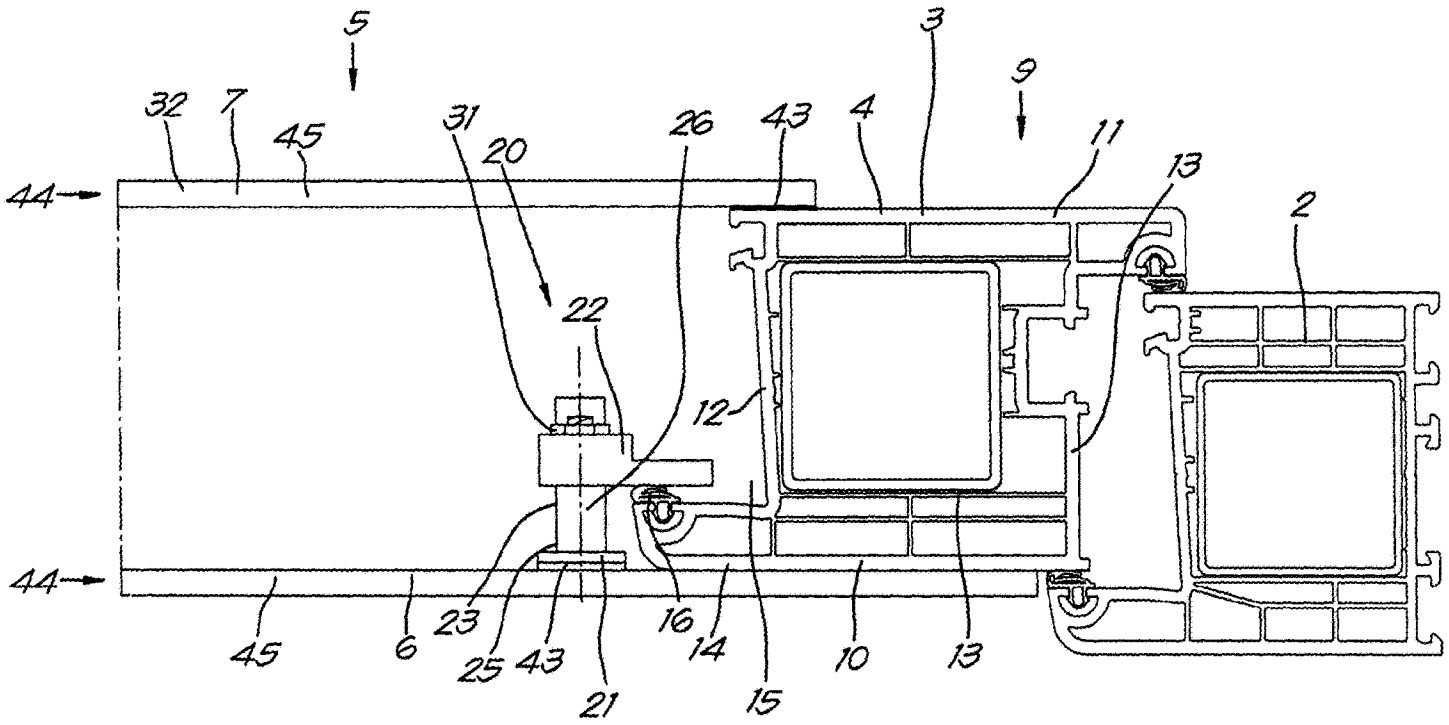

In the embodiment of FIG. 14 the front leaf 6 and the back leaf 7 are both constructed of single glass 44 with one single sheet of glass 45, whereby the front leaf with the clamping means 20 is fastened against the front of the frame 4, and the back leaf 7 is stuck to the back of the frame 4 with double-sided tape 43.

It is clear that more than two double glass sets 44 can also be used or multiple double glass sets 44 with more than two sheets of glass 45 can be used or laminated glass 44 or similar.

A panel kit for the use of glazing or other transparent material is composed for example of an aforementioned basic kit whereby the front leaf and the back leaf are made of glass or similar, and whereby the basic kit is further provided with adhesive in the form of a double-sided tape 43 or similar.

The present invention is by no means limited to the embodiment described as an example and shown in the drawings, but a door leaf and panel kit according to the invention can be realised in all kinds of forms and dimensions, without departing from the scope of the invention.

The invention claimed is:

1. Door leaf comprising a frame (4) and a door panel (5) with a front leaf (6) and a back leaf (7), whereby the frame (4) is composed of conventional profiles (9) with a front wall (10) and back wall (11), respectively on the front and back of the frame (4), an inner wall (12) and an outer wall (13), respectively on the inner edge and outer edge of the frame (4), and a lip (14) oriented inwards is provided on the inner wall (12) of the profiles (9) to form a groove (15) and whereby the front leaf (6) is affixed against the front of the frame (4), hereby at least partially covering the front of the frame (4), wherein the front leaf (6) is provided with clamping means (20) that enable the front leaf (6) to be pulled against the front of the frame (4), whereby these clamping means (20) are formed by one or more clamps along the periphery of the frame (4) with a basic element (21) that is fastened on the front leaf (6) and a clamping slat (22) affixed thereon that hooks behind an aforementioned lip (14) and can be tightened on the basic element (21) towards the front leaf (6).

2. Door leaf according to claim 1, wherein the basic elements (21) are provided with one or more guides (26) that extend transversely to the plane of the front leaf (6) and on which the clamping slats (22) are movably affixed.

3. Door leaf according to claim 1, wherein the clamping means (20) are provided with screwing means to tighten a clamping slat (22) against the lip (14) of the profiles (9).

4. Door leaf according to claim 1, wherein the basic elements (21) of the clamping means (20) are fastened to the back of the front leaf (6) by means of double-sided tape (43) or another adhesive.

5. Door leaf according to claim 1, wherein the front leaf (6) is metal, and the basic elements (21) of the clamping means (20) are fastened to the front leaf (6) by means of one or more fishplate bolts (23) that are welded on the back of the front leaf (6) and which extend transversely to the plane of this back.

6. Door leaf according to claim 1, wherein a filler plate (8) or a spacer is provided between the front leaf (6) and the back leaf (7) whose outer dimensions are somewhat smaller than the door openings (A) of the frame (4) and that the filler plate (8) or the spacer is glued by one side to the back of the front leaf (6).

7. Door leaf according to claim 1, wherein there are clipping means (35) with which the back leaf (7) is detachably fastened against the back of the filler plate (8) or spacer.

8. Door leaf according to claim 7, wherein the clipping means (35) are formed by a series of clips (36) that are fastened on the front of the back leaf (7) and which are provided with arms (37) that spring out sideways by which the clips (36) are clamped in corresponding openings (33) in the filler plate (8).

9. Door leaf according to claim 7, wherein a reinforcing plate (32) of an incompressible material is affixed on the back of the filler plate (8), whereby this reinforcing plate (8) is provided with passages (34) corresponding to the openings (33) in the filler plate (8) and with a diameter (C) that is somewhat smaller than the largest external diameter (D) of the clips (36) in their rest position.

10. Door leaf according to claim 8, wherein the clips (36) are screw clips that are fastened on the back leaf (7) by means of fishplate bolts (39) that are fastened on the front of the back leaf (7).

11. Door leaf according to claim 1, wherein the front leaf (6) and/or the back leaf (7) are formed by at least one sheet of glass (45) of single, double or laminated glass (44).

12. Door leaf according to claim 11, wherein the front leaf (6) is formed by at least one sheet of glass (45) of double or laminated glass (44) and that the back leaf (7) is formed by at least one sheet of glass (45) of another double or laminated glass (44), whereby the double or laminated glass (44) to which the front leaf (6) belongs and the double or laminated glass (44) to which the back leaf (7) belongs, are fastened against one another by means of double-sided tape (43).

13. Door leaf according to claim 1, wherein the dimensions of the back leaf (7) are somewhat smaller than the groove dimensions (B) of the frame (4) and that the gap (40) between the door panel (5) at the back of the frame (4) is covered by means of panel slats (17) or decorative slats (41).

14. Door leaf according to claim 13, wherein the panel slats (17) are fastened on the frame (4) in a groove provided to this end on the inner wall (12) of the frame (4), whereby these panel slats (17) are provided with a seal (18) for sealing off the back plate (7), whereby the thickness of the assembled door leaf (3) is chosen such that in the mounted state the seals (18) of the panel slats (17) press on the back of the back leaf (7).

15. Door leaf according to claim 1, wherein the dimensions of the back leaf (7) are larger than the groove dimensions (B) of the frame (4) and that the back of the frame (4) is at least partially covered by this oversized back leaf (7), whereby the back leaf (7) rests against the back of the frame (4) or is fastened against by gluing or similar.

16. Panel kit for assembling a door leaf comprising;

a frame (4) made of standard profiles (9) with a lip (14) to form a groove (15), a front leaf (6) with one or more basic elements (21) affixed thereon at a distance from a peripheral edge of the frame (4), the basic elements (21) forming part of a clamping means (20) to clamp the front leaf (6) to the frame (4);

one or more clamping slats (22) that can engage with the basic elements (21) of the clamping means (20);

means to be able to tighten the clamping slats (22) on the basic elements (21); and a separate back leaf (7).

17. Panel kit according to claim 16, wherein:

the front leaf (6) is provided with a filler plate (8) that extends between the basic elements (21), and which is fastened against the back of the front leaf (6) and which is provided with a series of openings (33);

the filler plate (8) is provided with a reinforcing plate (32) that is fastened against the back of the filler plate (8), and which is provided with passages (34) corresponding to the openings (33) in the filler plate (8);

the back leaf (7) is provided with clipping means (35) that can engage with the openings (33) in the filler plate and/or the passages (34) in the reinforcing plate (32) in order to be able to fasten the back leaf (7) against the filler plate (8) or reinforcing plate (32).

18. Door leaf according to claim 5, wherein the front leaf (6) is aluminium.

19. Door leaf according to claim 9, wherein the reinforcing plate (32) comprises aluminium.

20. Door leaf according to claim 2, wherein the clamping means (20) are provided with screwing means to tighten a clamping slat (22) against the lip (14) of the profiles (9).

* * * * *